US010533734B2

(12) United States Patent
Jiang

(10) Patent No.: US 10,533,734 B2
(45) Date of Patent: Jan. 14, 2020

(54) MULTI-LAMP STAGE LIGHT

(71) Applicant: Guangzhou Haoyang Electronic Co., Ltd., Guangzhou (CN)

(72) Inventor: Weikai Jiang, Guangzhou (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 0 days.

(21) Appl. No.: 16/107,330

(22) Filed: Aug. 21, 2018

(65) Prior Publication Data

US 2018/0356081 A1 Dec. 13, 2018

Related U.S. Application Data

(63) Continuation of application No. PCT/CN2016/098243, filed on Sep. 6, 2016.

(30) Foreign Application Priority Data

Mar. 31, 2016 (CN) ..... 2016 1 0197525

(51) Int. Cl.
*F21V 21/30* (2006.01)
*F21V 21/15* (2006.01)
(Continued)

(52) U.S. Cl.
CPC ..... *F21V 21/30* (2013.01); *F21V 21/15* (2013.01); *F21V 21/28* (2013.01); *F21W 2131/406* (2013.01)

(58) Field of Classification Search
CPC ..... F21V 21/30; F21V 21/28; F21V 21/06; F21V 21/29; F21W 2131/406
(Continued)

(56) References Cited

U.S. PATENT DOCUMENTS 6,120,164 A * 9/2000 Libin ..... F21V 21/30 362/227
7,614,766 B2 * 11/2009 Wang ..... F21V 14/02 248/183.1
(Continued)

FOREIGN PATENT DOCUMENTS

CN 201180949 Y 1/2009
CN 102713425 A 10/2012
(Continued)

OTHER PUBLICATIONS

International Search Report for Application No. PCT/CN2016/098243, dated Nov. 16, 2016.

*Primary Examiner* — William N Harris
(74) *Attorney, Agent, or Firm* — Lerner, David, Littenberg, Krumholz & Mentlik, LLP

(57) ABSTRACT

The present invention discloses a multi-lamp stage light including a base, a support frame rotatably connected to the base, a lamp support rotatably connected to the support frame, and at least two lamp units rotatably connected to the lamp support which is provided with a third driving apparatus for driving the lamp units to rotate. The stage light according to the present invention is simple in structure and easy to use, achieving variable lighting effects with omni-directional illumination and meeting performance requirements. In addition, the present invention can also avoid control lines intertwined.

8 Claims, 4 Drawing Sheets

(51) Int. Cl.
*F21W 131/406* (2006.01)
*F21V 21/28* (2006.01)

(58) Field of Classification Search
USPC ..... 362/249.1
See application file for complete search history.

(56) References Cited

U.S. PATENT DOCUMENTS

| | | | | |
|---|---|---|---|---|
| 8,979,304 | B2 * | 3/2015 | Mart | F21V 21/30 362/243 |
| 10,018,338 | B2 * | 7/2018 | Jurik | F21V 21/15 |
| 10,349,490 | B2 * | 7/2019 | Sato | G06T 7/74 |
| 2008/0068839 | A1 * | 3/2008 | Matheson | F21S 2/005 362/249.07 |
| 2011/0261568 | A1 | 10/2011 | Dalsgaard | |
| 2012/0307486 | A1 * | 12/2012 | Gordin | F21S 4/00 362/223 |
| 2014/0301078 | A1 * | 10/2014 | Gordin | F21S 4/00 362/236 |
| 2015/0016106 | A1 * | 1/2015 | Belliveau | F21V 14/02 362/233 |
| 2015/0062902 | A1 * | 3/2015 | Velazquez | F21V 21/14 362/249.07 |

FOREIGN PATENT DOCUMENTS

| | | | |
|---|---|---|---|
| CN | 203115665 | U | 8/2013 |
| CN | 104566172 | A | 4/2015 |
| CN | 204328860 | U | 5/2015 |
| CN | 204534423 | U | 8/2015 |
| CN | 104930452 | A | 9/2015 |
| CN | 105716033 | A | 6/2016 |
| EP | 2843303 | A1 | 3/2015 |
| WO | 2015077384 | A1 | 5/2015 |

* cited by examiner

MULTI-LAMP STAGE LIGHT

CROSS REFERENCE TO RELATED APPLICATIONS

The present application is a continuation of International Application No. PCT/CN2016/098243, filed Sep. 6, 2016, which claims priority from Chinese Patent Application No. 201610197525.8 filed Mar. 31, 2016, all of which are hereby incorporated herein by reference.

TECHNICAL FIELD

The present invention relates to the technical field of stage light, and in particular to a multi-lamp stage light.

BACKGROUND ART

In the field of stage lighting, stage lighting fixtures and their technology may usually be employed to display environment, exaggerate atmosphere, highlight a central character, create sense of space and time on a stage, shape appearance of stage and provide necessary lighting effects, through light colors and their changes.

In the prior art, the stage lighting fixture is usually provided with one light source which can only produce a single lighting effect. Accordingly, to achieve multi lighting effects there must be various optical elements. Such lighting fixture however can only project a light beam in one direction, which cannot cater to people's variable requirements on stages.

In order to improve the above problems, CN 200820044427.1 discloses a moving stage lighting unit with multi light source, which comprises a lamp base, a support, and a lamp unit provided with a first light source and a second light source installed on the front side of the first light source. The second light source is installed on a mounting base, a second light source lens matched with the second light source is installed on a lens plate, and a light-shield plate is provided between the base plate and the lens plate. Although this kind of stage lighting unit with multi light source can emit light by multiple light sources, light emitting directions of each light source are the same and cannot be changed, so that stage lighting effect produced is still relatively single, and it is difficult to present varying lighting effects even when the stage lighting unit is rotating.

In addition, CN 201510374538.3 discloses a stage lighting unit capable of dynamically universally changing directions including a lamp base, a rotation plate, a first driving apparatus, at least three lamps, and transmission mechanisms corresponding to the lamps one by one. Each lamp is movably installed on the lamp base, and each lamp is universal rotary hinge joint to the rotation plate via the respective transmission mechanism. The first driving apparatus is connected with the rotation plate so as to drive the rotation of the rotation plate. Such lighting unit is provided with a plurality of rotatable lamps for projecting multi light beams, but the lamp can only rotate about the axis of its own, namely axis of the light beam, so that the rotation direction is extremely limited, resulting in restriction of the lighting direction of each lamp, thus omnidirectional light projection cannot be really realized through such light unit. On the other hand, the lamps are driven by a set of driving apparatus simultaneously, and it is not possible to drive each lamp individually according to practical demands, so that the lighting effect is further extremely limited.

SUMMARY OF THE INVENTION

In order to overcome at least one of the above problems of the prior art, the present invention provides a multi-lamp stage light, simple in structure and easy to use, which can achieve variable lighting effects with omnidirectional light projection and meet performance requirements. In addition, the present invention can also avoid control lines intertwined.

In order to solve the above technical problem, the present invention provides a multi-lamp stage light including a base, a support frame rotatably connected to the base, a lamp support rotatably connected to the support frame, and at least two lamp units rotatably connected to the lamp support which is provided with a third driving apparatus for driving the lamp units to rotate. Preferably, the third driving apparatus correspond to the lamp units one by one, and each lamp unit is driven by its corresponding third driving apparatus. The rotation of each lamp unit is driven by the corresponding third driving apparatus independently, thus the lamp units can be controlled individually or simultaneously. According to requirements on different stage performance, each lamp unit can be controlled to rotate at a same angle simultaneously, or at different angle individually, achieving variable lighting effects with omnidirectional light projection and meeting performance requirements.

Further, the lamp support includes a transverse support and a main support. The support frame is preferably a U-shaped support frame with the transverse support bridged between its two side walls. The transverse support is rotatably connected to the support frame via a second rotation shaft mechanism provided between the transverse support and the support frame, so that the transverse support can rotate 360° about the axis of the second rotation shaft mechanism. And the main support is rotatably connected to the transverse support via a fourth rotation shaft mechanism provided between the main support and the transverse support, so that the main support can also rotate 360° about the axis of the fourth rotation shaft mechanism, thus further ensuring dynamic and omnidirectional changes of lighting patterns output by the stage light according to the present invention.

Further, the main support is provided with a plurality of notches corresponding to the lamp units, the lamp units are disposed in the notches correspondingly, and the lamp units are uniformly distributed in an annular form on the main support. The main support is further provided with containing chambers in which the third driving apparatus are placed and installed correspondingly, and the containing chambers and the notches are arranged alternately. A third rotation shaft mechanism is provided between each lamp unit and its corresponding notch, rotatably installed on both side walls of the notch and correspondingly connected with the lamp unit and the third driving apparatus. In such configuration, the third driving apparatus correspondingly drives the third rotation shaft mechanism connected thereto to rotate so as to drive the rotation of the lamp unit connected to the third rotation shaft mechanism, and each lamp unit can rotate 360° omnidirectionally in the notch about the axis of the third rotation shaft mechanism.

Further, the support frame is rotatably connected to the base via a first rotation shaft mechanism provided between the support frame and the base and can rotate 360° about the axis of the first rotation shaft mechanism. A first driving apparatus connected to the first rotation shaft mechanism is provided inside the base, so that the first driving apparatus can drive the first rotation shaft mechanism to rotate so as to drive the rotation of the support frame. A second driving apparatus connected to the second rotation shaft mechanism is provided on the bottom of the support frame, and a fourth driving apparatus connected to the fourth rotation shaft mechanism is provided inside the transverse support. In this configuration, the second driving apparatus drives the second rotation shaft mechanism to rotate so as to drive the rotation of the transverse support. Similarly, the fourth driving apparatus drives the fourth rotation shaft mechanism to rotate so as to drive the rotation of the main support.

Further, the first rotation shaft mechanism, the second rotation shaft mechanism, the third rotation shaft mechanism and the fourth rotation shaft mechanism are preferably universal rotation shaft assemblies, which can effectively ensure flexible rotation movement of the support frame, the transverse support, the main support and each lamp unit, respectively. The first driving apparatus, the second driving apparatus, the third driving apparatus and the fourth driving apparatus are preferably electric motors or rotary pumps.

Further, a general control unit is provided inside the base for controlling movement of the stage light and a sub-control unit is correspondingly provided in each containing chamber for controlling each lamp unit.

Further, the support frame, the transverse support, the first rotation shaft mechanism, the second rotation shaft mechanism, the third rotation shaft mechanism, and the fourth rotation shaft mechanism are respectively provided with a wiring channel. Each containing chamber is provided with an upper wiring port at the top and a lower wiring port at the bottom. Control lines of the general control unit pass through the wiring channel of the first rotation shaft mechanism, the wiring channel of the support frame, the wiring channel of the second rotation shaft mechanism, and the wiring channel of the transverse support sequentially, and then are divided into two groups. One group enters the containing chambers from the lower wiring ports thereof, and the other group enters the wiring channel of the fourth rotation shaft mechanism from a lower side thereof, then passes through an upper end of the fourth rotation shaft mechanism, and finally enters the containing chambers from the upper wiring ports thereof.

In the present invention, there are two ways to connect the two groups of the control lines entering the containing chambers to the corresponding connection objects thereof. In one way, the control lines entering the containing chambers from the lower wiring ports thereof are separately connected to the control circuits of the third driving apparatus in the containing chambers, correspondingly; and the control lines entering the containing chambers from the upper wiring ports thereof separately pass through the wiring channels of the third rotation shaft mechanisms correspondingly and enter the corresponding lamp units so as to connect to components therein. In the other way, the control lines entering the containing chambers from the lower wiring ports thereof separately pass through the wiring channels of the third rotation shaft mechanisms correspondingly and enter the corresponding lamp units so as to connect to the components therein; and the control lines entering the containing chambers from the upper wiring ports thereof are separately connected to the control circuits of the third driving apparatus in the containing chambers correspondingly. With such arrangement, when the lamp units are rotated, the control lines will not be intertwined to affect the use of the stage light.

Further, the base, the support frame and the lamp support are respectively provided with a housing so as to protect internal parts of the stage light.

Compared with the prior art, some desirable effects can be obtained according to the present invention that a plurality of light sources in various directions are configured that light beams can be projected in various directions simultaneously, and each lamp unit can be controlled individually or simultaneously, thus achieving variable lighting effects with omnidirectional light projection and meeting the requirements of the performance; and each lamp unit is driven by a rotation shaft mechanism so that each lamp unit can achieve omnidirectional rotation. On the other hand, several wiring channels are provided so as to avoid the control lines inside the lamp units intertwined when the lamp units are rotating.

DETAILED DESCRIPTION

Figure 1:
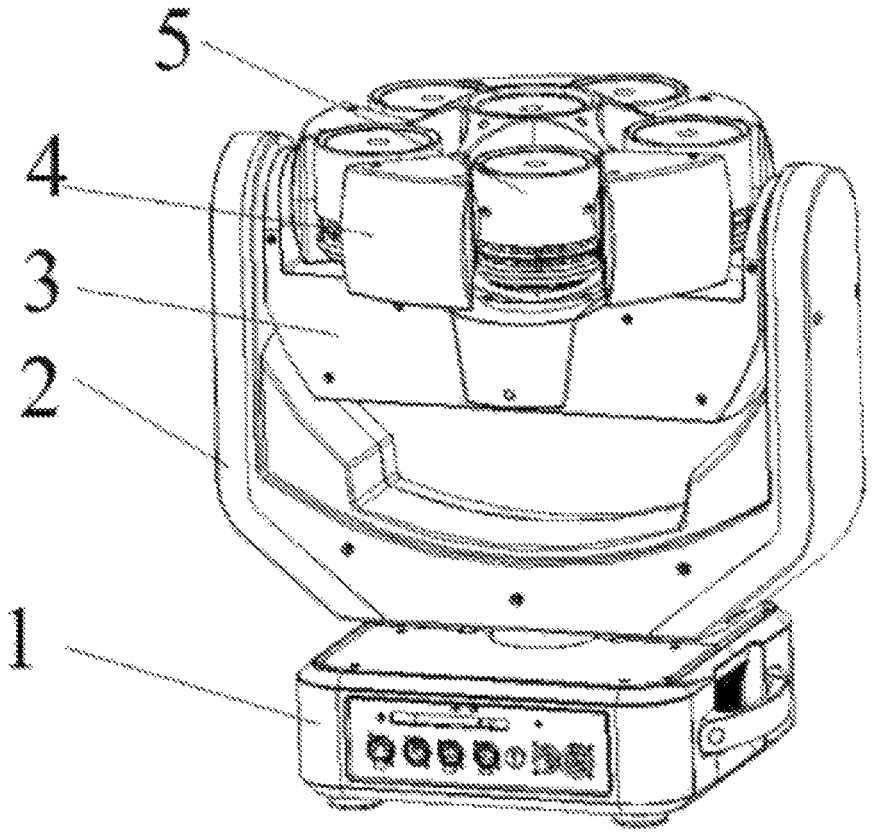
FIG. 1 is a schematic view of an overall structure of the present invention.

The drawings are only for illustrative purposes and should not be construed as a limit to the present invention. In order to better illustrate the embodiments, some parts in the drawings may be omitted, enlarged or reduced, and the sizes do not represent the actual sizes of the products. For those skilled in the art, it will be understood that some known structures in the drawings and descriptions thereof are omitted. The positional relationships described in the drawings are for illustrative purposes only and are not intended to limit the present invention.

FIG. 1 to FIG. 4 show a multi-lamp stage light including a base 1, a support frame 2 rotatably connected to the base 1, a lamp support rotatably connected to the support frame 2, and a plurality of lamp units 5 rotatably connected to the lamp support which is provided with a plurality of third driving apparatuses 15 corresponding to the lamp units one by one for driving each lamp unit to rotate independently, i.e. the rotation of each lamp unit 5 is driven by a corresponding third driving apparatus 15 independently, thus the lamp units 15 can be controlled individually or simultaneously. According to requirements on different stage performance, the lamp units 5 can be controlled to rotate at a same angle simultaneously, or at different angles individually, thus achieving variable lighting effects with omnidirectional light projection and meeting performance requirements.

Figure 2:
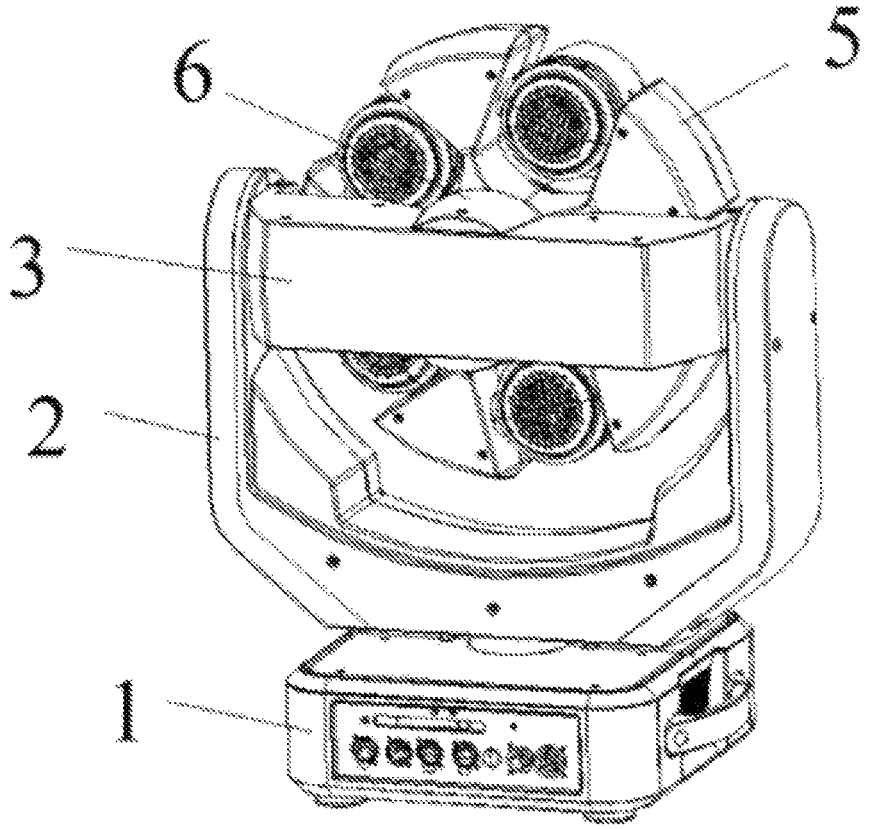
FIG. 2 is a rear view of the structure shown in FIG. 1.

As shown in FIG. 1 and FIG. 2, the lamp support includes a transverse support 3 and a main support 4. The support frame 2 is preferably a U-shaped support frame with the transverse support 3 bridged between its two side walls. The transverse support 3 is rotatably connected to the support frame 2 via a second rotation shaft mechanism 8 provided between the transverse support 3 and the support frame 2 so that the transverse support 3 can rotate 360° about the axis of the second rotation shaft mechanism 8. And the main support 4 is rotatably connected to the transverse support 3 via a fourth rotation shaft mechanism 6 provided between the main support 4 and the transverse support 3, so that the main support 4 can also rotate 360° about the axis of the fourth rotation shaft mechanism 6, thus further ensuring dynamic and omnidirectional changes of lighting patterns output by the stage light according to the present invention.

Figure 3:
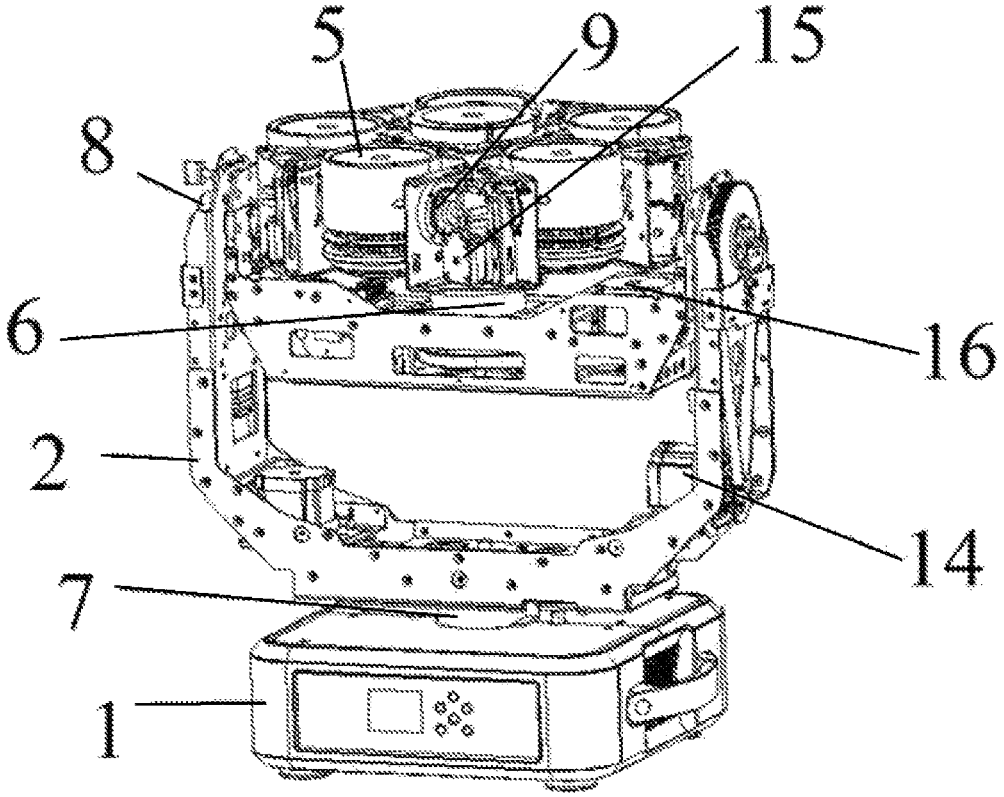
FIG. 3 is a schematic view of the structure shown in FIG. 1 with some parts removed.
Figure 4:
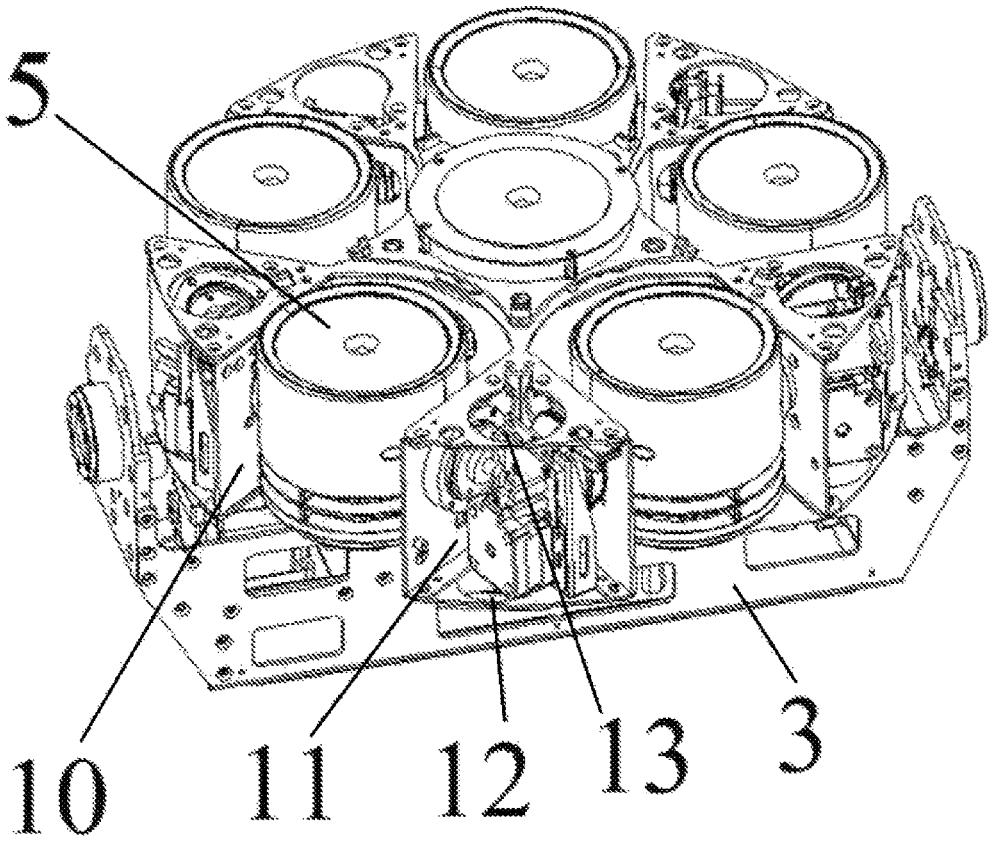
FIG. 4 is a schematic view of a lamp support and lamp units shown in FIG. 3.

As shown in FIG. 3 and FIG. 4, the main support 4 is provided with a plurality of notches 10 corresponding to the lamp units 5 disposed in the notch 10 correspondingly, and the lamp units 5 are uniformly distributed on the main support 4 in an annular form. The main support 4 is further provided with containing chambers 11 in which the third driving apparatuses 15 are placed and installed, and the containing chambers 11 and the notches 10 are arranged alternately. A third rotation shaft mechanism 9 is provided between each lamp unit 5 and its corresponding notch 10, rotatably installed on both side walls of the notch 10 and connected with the lamp unit 5 and the third driving apparatus 15 correspondingly. The third driving apparatus 15 drives the third rotation shaft mechanism 9 connected thereto to rotate so as to drive the rotation of the lamp unit 5 connected to the third rotation shaft mechanism 9, and each lamp unit 5 can rotate 360° omnidirectionally in the notch 10 about the axis of the third rotation shaft mechanism 9.

As shown in FIG. 3, the support frame 2 is rotatably connected to the base 1 via a first rotation shaft mechanism 7 provided between the support frame 2 and the base 1, and can rotate 360° about the axis of the first rotation shaft mechanism 7. A first driving apparatus connected with the first rotation shaft mechanism 7 is provided inside the base 1, so that the first driving apparatus can drive the first rotation shaft mechanism 7 to rotate so as to drive the rotation of the support frame 2. A second driving apparatus 14 connected to the second rotation shaft mechanism 8 is provided at the bottom of the support frame 2, and a fourth driving apparatus 16 connected to the fourth rotation shaft mechanism 6 is provided inside the transverse support 3. The second driving apparatus 14 drives the second rotation shaft mechanism 8 to rotate so as to drive the rotation of the transverse support 3. Similarly, the fourth driving apparatus 16 drives the fourth rotation shaft mechanism 6 to drive the rotation of the main support 4.

In this embodiment, the first rotation shaft mechanism 7, the second rotation shaft mechanism 8, the third rotation shaft mechanism 9 and the fourth rotation shaft mechanism 6 are universal rotation shaft assemblies, which can effectively ensure flexible rotation movement of the support frame 2, the transverse support 3, the main support 4 and the lamp units 5, respectively. The first driving apparatus, the second driving apparatus 14, the third driving apparatus 15 and the fourth driving apparatus 16 are preferably electric motors.

In the embodiment, a general control unit is provided inside the base 1 for controlling movement of the stage light, and a sub-control unit is correspondingly provided in each containing chamber 11 for controlling movement of the lamp unit 5.

In the embodiment, the support frame 2, the transverse support 3, the first rotation shaft mechanism 7, the second rotation shaft mechanism 8, the third rotation shaft mechanism 9, and the fourth rotation shaft mechanism 6 is respectively provided with a wiring channel. Each containing chamber 11 is provided with an upper wiring port 13 at the top and a lower wiring port 12 at the bottom. Control lines of the general control unit sequentially pass through the wiring channel of the first rotation shaft mechanism 7, the wiring channel of the support frame 2, the wiring channel of the second rotation shaft mechanism 8, and the wiring channel of the transverse support 3, and then are divided into two groups. One group enters the containing chambers 11 from the lower wiring ports 12 thereof, the other group enters the wiring channel of the fourth rotation shaft mechanism 6 from a lower side thereof, then passes through an upper end of the fourth rotation shaft mechanism 6, and finally enters the containing chambers 11 from the upper wiring ports 13 thereof.

In the embodiment, the control lines entering the containing chambers 11 from the lower wiring ports 12 thereof are separately connected to the control circuits of the third driving apparatuses 15 in the containing chambers 11, correspondingly; and the control lines entering the containing chambers 11 from the upper wiring ports 13 thereof separately pass through the wiring channels of the third rotation shaft mechanisms 9 correspondingly and enter the corresponding lamp units 5 so as to connect to components therein. Of course, another implementation can also be adopted, that is, the control lines entering the containing chambers 11 from the lower wiring ports 12 thereof separately pass through the wiring channels of the third rotation shaft mechanisms 9 correspondingly and enter the corresponding lamp units 5 so as to connect to the components therein; and the control lines entering the containing chambers 11 from the upper wiring ports 13 thereof are separately connected to the control circuits of the third driving apparatuses 15 in the containing chambers 11 correspondingly. With such arrangement, when the lamp units 5 are rotated, the control lines will not be intertwined to affect the use of the stage light.

As shown in FIG. 1 and FIG. 2, the base, the support frame and the lamp support are respectively provided with a housing so as to protect internal parts of the stage light.

Obviously, the above embodiments of the present invention are merely examples for clear illustration and are not intended to limit the embodiments of the present invention. For those skilled in the art, other modifications or changes can be made on the basis of the above description. There is no need and no exhaustion for all implementations. Any modification, equivalent substitution or improvement, or the like within the spirit and principle of the present invention shall be included in the scope of claims of the present invention.

The invention claimed is:

1. A multi-lamp stage light, comprising:

a base;

a support frame rotatably connected to the base;

a lamp support rotatably connected to the support frame;

at least two lamp units rotatably connected to the lamp support which is provided with a third driving apparatus for driving the lamp units to rotate, wherein the lamp support includes a transverse and a main support support, wherein the transverse support is rotatably connected to the support frame via a second rotation shaft mechanism provided between the transverse support and the support frame, wherein the main support is rotatably connected to the transverse support via a fourth rotation shaft mechanism provided between the main support and the transverse support, wherein the transverse support and the main support rotate around different axes, wherein the third driving apparatus corresponds to the lamp units one by one, and each lamp unit is correspondingly driven by each third driving apparatus, wherein the main support is provided with notches corresponding to each lamp unit and each lamp unit is correspondingly provided in the notch, wherein the main support is further provided with containing chambers in which each third driving apparatus is correspondingly placed and installed, and wherein the containing chambers and the notches are arranged alternately.

2. The multi-lamp stage light according to claim 1, wherein a third rotation shaft mechanism is provided between each lamp unit and its corresponding notch, rotatably installed on a pair of side walls of the notch and correspondingly connected with the lamp unit and the third driving apparatus.

3. The multi-lamp stage light according to claim 2, wherein the support frame is rotatably connected to the base via a first rotation shaft mechanism provided between the support frame and the base, a first driving apparatus connected to the first rotation shaft mechanism is provided inside the base, and wherein a second driving apparatus connected to the second rotation shaft mechanism is provided at a bottom of the support frame and a fourth driving apparatus connected to the fourth rotation shaft mechanism is provided inside the transverse support.

4. The multi-lamp stage light according to claim 3, wherein the first rotation shaft mechanism, the second rotation shaft mechanism, the third rotation shaft mechanism and the fourth rotation shaft mechanism are universal rotation shaft assemblies for effectively ensuring flexible rotation movement of the support frame, the transverse support, the main support, and the lamp units, respectively.

5. The multi-lamp stage light according to claim 3, wherein a general control unit is provided inside the base, and a sub-control unit corresponding to each lamp unit is correspondingly provided in each containing chamber.

6. The multi-lamp stage light according to claim 5, wherein the support frame, the transverse support, the first rotation shaft mechanism, the second rotation shaft mechanism, the third rotation shaft mechanism, and the fourth rotation shaft mechanism are respectively provided with a wiring channel, wherein each containing chamber is provided with an upper wiring port on a top and a lower wiring port at a bottom, and wherein control lines of the general control unit pass through the wiring channel of the first rotation shaft mechanism, the wiring channel of the support frame, the wiring channel of the second rotation shaft mechanism, and the wiring channel of the transverse support sequentially, and then are divided into two groups, one group enters the containing chamber from the lower wiring port thereof; and the other group passes through the wiring channel of the fourth rotation shaft mechanism, and enters the containing chamber from the upper wiring ports thereof.

7. The multi-lamp stage light according to claim 6, wherein the control lines entering the containing chamber from the lower wiring port thereof are correspondingly connected to a control circuit of the third driving apparatus in each containing chamber, and the control lines entering the containing chamber from the upper wiring port thereof correspondingly pass through the wiring channel of the third rotation shaft mechanism and enter the lamp unit so as to be connected to components therein; or the control lines entering the containing chamber from the lower wiring port thereof correspondingly pass through the wiring channel of the third rotation shaft mechanism and enter the lamp unit so as to be connected to components therein, and the control lines entering the containing chamber from the upper wiring port thereof are correspondingly connected to the control circuits of the third driving apparatus in each containing chamber.

8. The multi-lamp stage light according to claim 1, wherein the support frame is a U-shaped support frame, the transverse support is bridged between a pair of side walls of the U-shaped support frame, and each lamp unit is uniformly distributed in an annular shape.

* * * * *